United States Patent [19]

Ishii

[11] 3,956,985

[45] May 18, 1976

[54] OPERATING LEVER MECHANISM FOR OFFSET PRINTING PRESS

[75] Inventor: Koji Ishii, Fukuyama, Japan

[73] Assignee: Ryobi, Ltd., Hiroshima, Japan

[22] Filed: Nov. 18, 1974

[21] Appl. No.: 524,823

[30] Foreign Application Priority Data

Nov. 16, 1973 Japan ..... 48-128877

[52] U.S. Cl. ..... 101/142; 101/144; 101/217

[51] Int. Cl.² ..... B41F 7/40

[58] Field of Search ..... 101/132, 132.5, 141, 101/142, 144, 217

[56] References Cited

UNITED STATES PATENTS

| | | | |
|---|---|---|---|
| 3,303,778 | 2/1967 | Tonkin et al. | 101/144 |
| 3,601,045 | 8/1971 | Schinke et al. | 101/144 |
| 3,702,586 | 11/1972 | Kaneko et al. | 101/142 |

*Primary Examiner*—Edgar S. Burr
*Assistant Examiner*—R. E. Suter

[57] ABSTRACT

A mechanism which has a first cam plate pivotally mounted on an operating shaft having an operating lever joined thereto and a second cam plate pivotally mounted on an eccentric shaft of a master cylinder and moved with an arm fixed to the operating shaft. The first cam plate is formed with a pump switch cam, a set cam for operating the operating lever stepwise and a paper feed control cam. The second cam plate is formed with a form roller-separating cam and a master cylinder-separating cam. The form roller-separating cam causes press contact between a form roller and the master cylinder when the operating lever is set at the I position. When the operating lever is set at II, the master cylinder-separating cam forces the master cylinder to maintain its contact with a blanket cylinder, and when the operating lever is set at IV, the paper feed control cam allows a suction foot to move down to start paper feed through an auxiliary operating lever.

9 Claims, 5 Drawing Figures

OPERATING LEVER MECHANISM FOR OFFSET PRINTING PRESS

This invention relates to an operating lever mechanism for an offset printing press.

Generally, in practicing printing with an offset printing press, it needs to make certain preliminary arrangements such as applying ink over the plate clamped around the master cylinder, properly fixing the master and blanket cylinders or controlling paper feed. There are also required other complex operations for test printing and for paper feeding and other procedures in the actual printing process.

In the conventional offset printing presses of this kind, a great many of levers and grips were provided for performing the complex operations such as above mentioned and these parts have been operated in succession according to the printing process. However, as the printing process itself was complicated, the operations of these parts were very troublesome and also specific printing skills were required for operating such offset printing press.

An object of the present invention is to provide an improved operating lever mechanism which can eliminate the above-said defects of the prior art printing machines and which can be operated with ease for performing the printing process from inking to final printing by handling a single operating lever.

Another object of the present invention is to provide a mechanism whereby a single operating lever is rocked down stepwise to turn the operating shaft as well as the arm and cam plate secured to said shaft stepwise, thereby to successively operate the inking means operatively connected to said arm, master cylinder-separating means, and paper feed control means operatively connected to said cam plate.

Still another object of the present invention is to provide an improved trouble-free operating lever mechanism of a simple set-up by use of cam plates each of which is formed with a set of operating cams.

Figure 1:
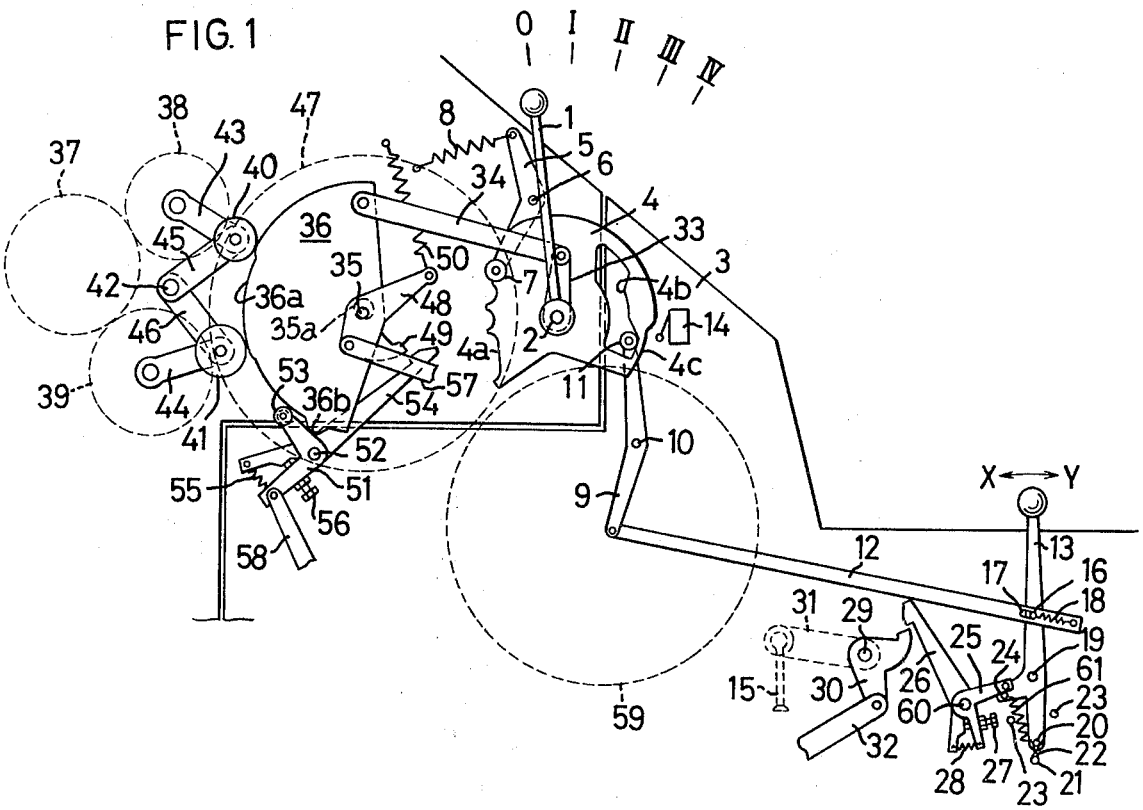
Figure 2:
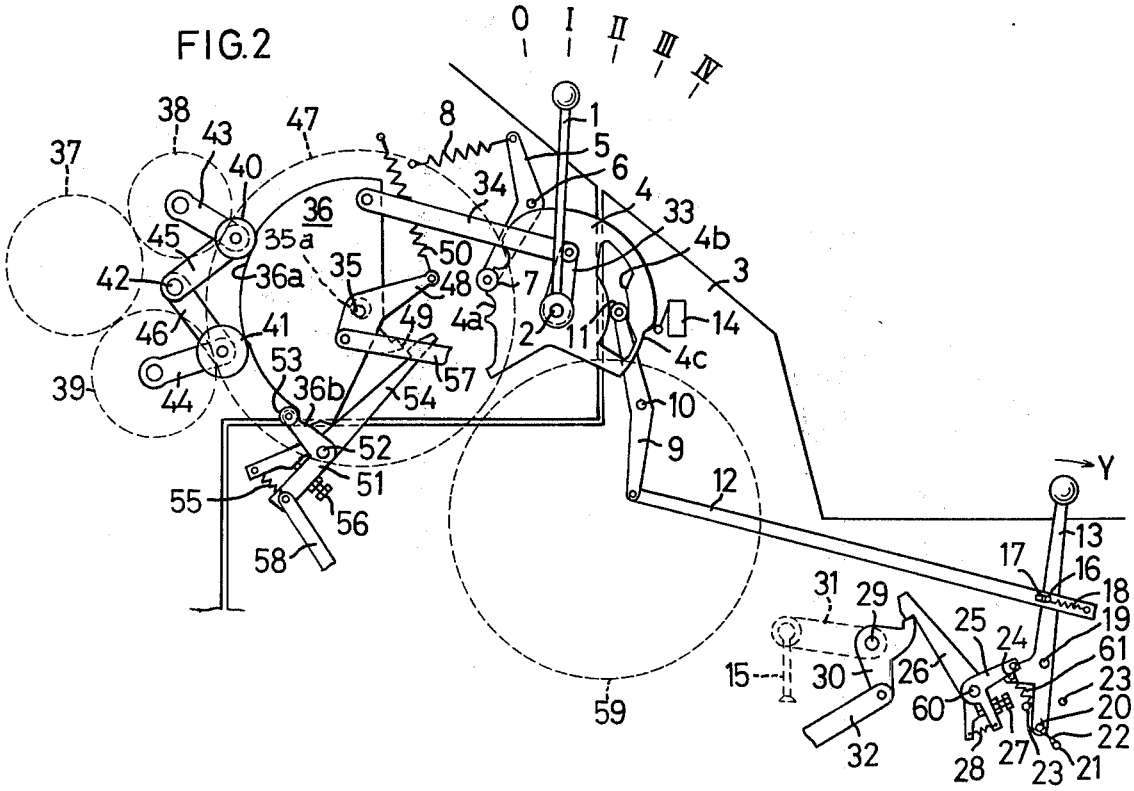
Figure 3:
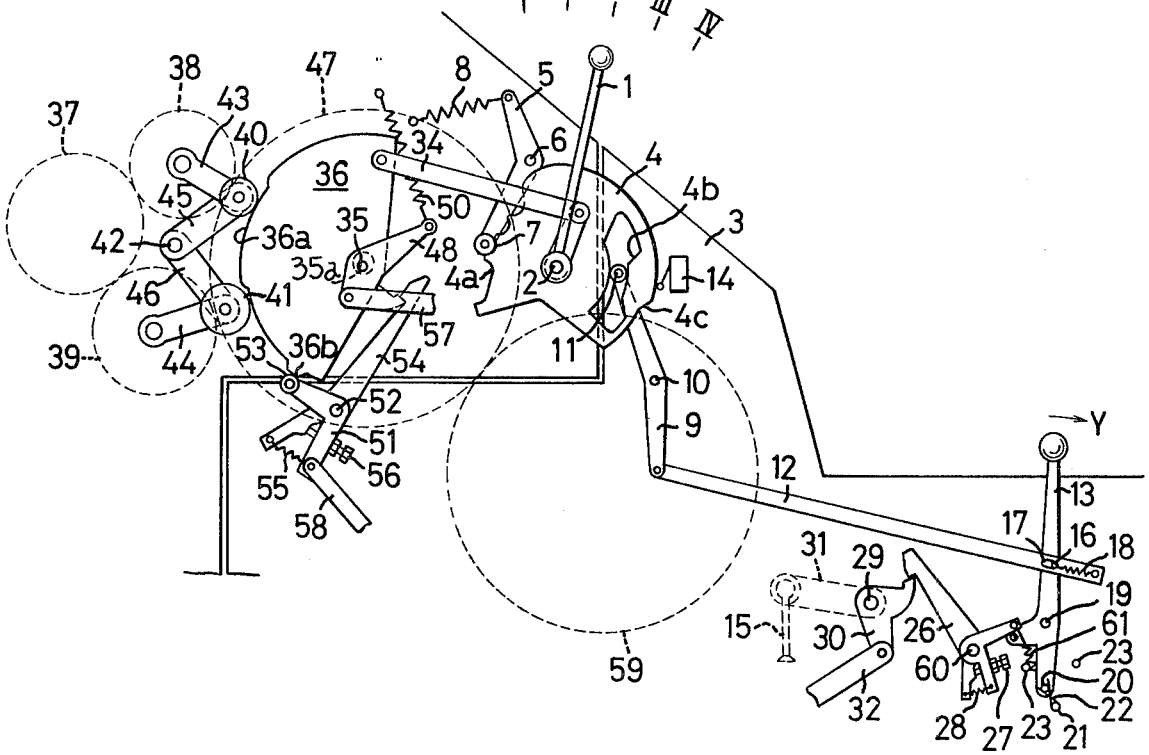
Figure 4:
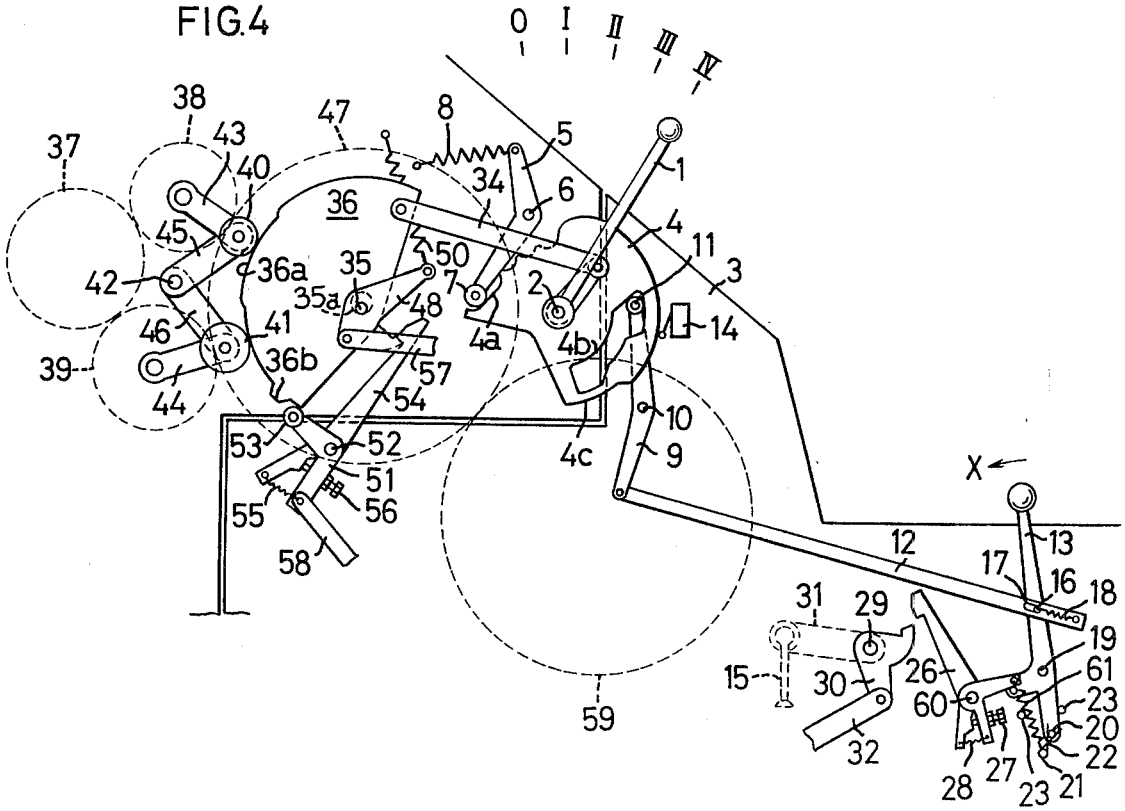
Figure 5:
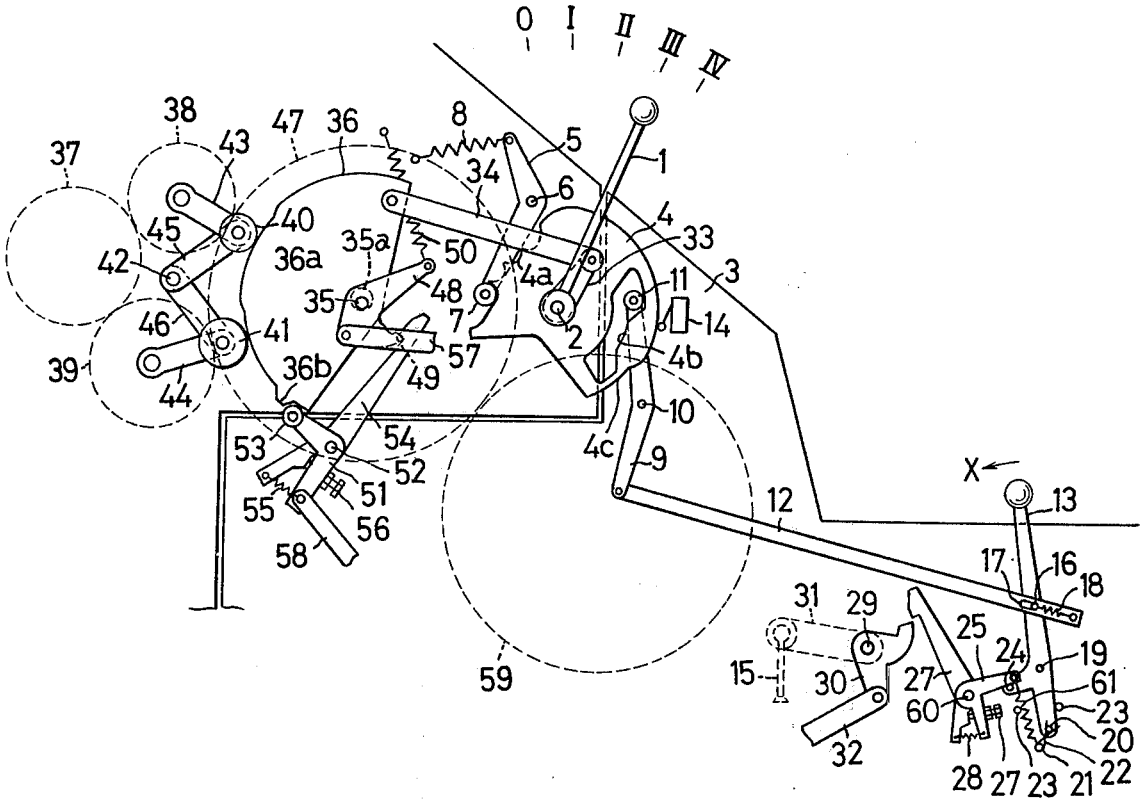

The other objects and advantages of the present invention will become apparent from the following detailed description of the invention taken in conjunction with the accompanying drawings, in which:

FIG. 1 is a fragmental enlarged side elevation showing the positional relation of the component parts at the zero position of the operating lever in an embodiment of the present invention; and FIGS. 2 to 5 are the views similar to FIG. 1 but showing the positional relations when the operating lever is set at the positions of I, II, IV and III, respectively.

Referring generally to the drawings, it will be seen that an operating lever 1 is pivotally secured to an operating shaft 2, with the top end grip of the lever 1 being positioned outside of the frame 3. Also pivotally secured to the operating shaft 2 are a first cam plate 4 and an arm 33. The first cam plate 4 is formed with a set cam 4*a*, a paper feed control cam 4*b* and a pump switch cam 4*c*. Numeral 5 denotes a lever which is pivotted at its central part by a stud 6 and carries at its one end a roller 7 which is engaged with the set cam 4*a* under the pressing force of a spring 8 connected between the other end of the lever 5 and the frame 3. There is also provided a lever 9 which is pivotted at its central part by a stud 10 and carries at its one end a roller 11 which is engaged with the paper feed control cam 4*b*, the other end of the lever 9 being connected to an auxiliary operating lever 13 through a link 12. 14 is a limit switch arranged to be connected or disconnected from the pump switch cam 4*c* to energize or disenergize the vacuum pump to control suction of the suction foot 15 of the paper feeding unit to be described later.

The auxiliary operating lever 13 is arranged operable manually to release the paper feed control for the purpose of test printing or for other ends. The link 12 has formed toward its free end an elongated slot 17 in which fits a pin 16 erected on the lever 13 and is elastically pressed by a spring 18. At the free end of the auxiliary operating lever 13 (which is centrally pivotted by a stud 19) is erected a pin 20 to which is connected a torsion spring 22 passed from a spring lock 21 so that the lever 13 can be swung forwardly or rearwardly, or in the direction of arrows X and Y, to the position of a stopper 23. Also erected from a central protuberance of the auxiliary operating lever 13 is a pin 24 which is engaged with an end of an L-shaped lever 25 pivotted by a stud 60 which also pivotally connects the lever 25 to a latch 26. Numeral 27 designates an adjusting screw for adjusting the relative positions of the L-shaped lever 25 pulled by a spring 28 and the latch 26. The spring 28 is designed to maintain the L-shaped lever 25 and latch 26 at their adjusted relative positions. 61 is a spring adapted for pressing the L-shaped lever 25 against the pin 24 on the auxiliary operating lever 13. Provided in operative relation with the latch 26 is a lever 30 pivotally secured to a shaft 29 to which is also pivotally secured an arm 31 having at its other end the suction foot 15 so as to transmit movement of a link 32 to the arm 31. Thus, when the lever 30 is engaged with the latch 26, the suction foot 15 can not descend and hence paper feed is stopped.

The movement of the arm 33 pivotally secured to the operating shaft 2 is transmitted through the link 34 to a second cam plate 36 loosely fitted on the eccentric shaft 35 extending from the concentric shaft 35a of the master cylinder 47, so as to turn the second cam plate 36. This cam plate 36 is formed with a form roller-separating cam 36*a* and a master cylinder-separating cam 36*b*. The form rollers 38 and 39 arranged to turn in contact with an oscillating roller 37 are designed to approach or separate from the master cylinder 47 through a shaft 42 and arms 43, 44,45 and 46 by the rollers 40 and 41 contacted with the cam 36*a*. 48 is a lever having at its one end an engaging protuberance 49 and fixed at its central part by the eccentric shaft 35, with the other end of the lever 48 being elastically pulled by a spring 50 passed between the other end and the frame 3. 51 is an L-shaped lever which is centrally pivotted by a stud 52 and carries at its one end a roller 53 engaged with the cam 36 *b* and is adapted to operate a latch 54 which is also pivotted by the stud 52. 56 is an adjusting screw for adjusting the relative positions of the L-shaped lever 51 and latch 54, the adjusted positions of the both members being maintained by a spring 55. 57 is a link operatively connected to a drive means (not shown) and adapted to turn the lever 48. When the latch 54 is disengaged from the lever 48 to let the link move forwardly or backwardly, the eccentric shaft 35 is accordingly turned to let the master cylinder 47 separate from or attach to the rubber-blanketted cylinder 59. The lever 48 and latch 54 make rocking motions such that their engaging ends move away from or toward each other in accordance with the vehavior of the link 57 and a link 58 joined to the L-shaped lever

51.

Described in the foregoing were the arrangements of the operating lever mechanism in an offset printing press according to the present invention. Now, the operations and positional relations of the component parts of the lever mechanism are discussed in accordance with the respective operating steps.

By the action of cam set 4*a* with roller 7, operating lever 1 is positionable to one of five stable set positions; O, I, II, III, and IV.

When the operating lever 1 is set at 0 (FIG. 1), the form rollers 38 and 39 separate from the master cylinder 47 and the latter from the blanket cylinder 59, and the pump switch cam 4c turns off the limit switch 14 to produce the inoperative condition.

When the operating lever 1 is then set at I (FIG. 2), the form rollers 38, 39 contact with the master cylinder 47 and the auxiliary operating lever 13 is turned down forwardly, that is in the direction of arrow Y, through the lever 9 and link 12 by the action of the paper feed control cam 4*b*, thus engaging the latch 26 with the lever 30 to prevent descent of the suction foot 15, so that no paper is fed. Under this condition, ink is applied to the master cylinder surface.

If the operating lever 1 is now set at II (FIG. 3), although the form rollers 38, 39 remain contacted with the master cylinder 47, the master cylinder 47 is contacted with the blanket cylinder 59 by turn of the eccentric shaft 35 to cause forward movement of the link 57 to engage with and withhold the engaging end 49 of the lever 48 secured to the eccentric shaft 35 through the roller 53, L-shaped lever 51 and latch 54 by the action of the cam 36*b*, so that the master cylinder 47 maintains its pressed contact with the rubber blanket cylinder 59. Also, the auxiliary operating lever 13 is turned forwardly by the action of the paper feed control cam 4*b* through the lever 9 and link 12 to let the latch 26 engage with the lever 30, thus preventing downward movement of the suction foot 15, so that no paper feed is made, but the pump switch cam 4*c* keeps the limit switch on. When it is desired to perform test printing, the auxiliary operating lever 13 is turned backwardly in the direction of X through the elongated slot 16, whereby the latch 26 is disengaged from the lever 30 to allow paper feed. When the auxiliary operating lever 13 is released, it is forced back to its original position by the spring 18 to stop paper feed.

When the operating lever is then set at IV (FIG. 4), the auxiliary operating lever 13 is turned backwardly in the direction of arrow X by the action of the paper feed control cam 4b to disengage the latch 26 from the lever 30, allowing the suction foot 15 to move down in accordance with movement of the link 32 to start paper feed.

If the hand hold on the operating lever 1 set at IV is released, the lever 1 returns to and stops at the position of III (FIG. 5) by dint of the set cam 4*a*. Under this condition, the printing operation is continued, but the auxiliary operating lever 13 can be turned either forwardly or rearwardly, thereby to temporarily stop paper feed.

As described above, according to the offset printing press of the present invention, the printing operation from inking to printing-off can be accomplished with ease by operating a single operating lever. Thus, the present invention is not only capable of practicing offset printing by merely switching an operating lever stepwise regardless of the complicated printing process but is also extremely simple in its basic mechanism owing to use of composite cam means, so that there is brought about almost no mechanical deficiency that might otherwise result from simplification of operation.

What is claimed is:

1. In an offset printing press having a master cylinder, a rubber blanket cylinder, form rollers for inking the master cylinder, and a paper feed control mechanism for controlling the feeding of paper to the rubber blanket cylinder, the improvement comprising:

a main operating lever;

an operating shaft coupled to an end of said main operating lever and rotatable by said main operating lever;

a first cam plate coupled to said operating shaft and rotatable with said operating shaft about the axis of said shaft, said first cam plate having a paper feed control cam surface;

a cam following lever having means at one end riding against said paper feed control cam surface;

an auxiliary operating lever for activating the paper feed control mechanism;

an operating lever link having one end coupled to the other end of said cam following lever, and having its other end coupled to said auxiliary operating lever so that movement of said main operating lever causes movement of said auxiliary operating lever;

a pump switch for controlling a vacuum pump of the feed control mechanism, said pump switch actuatable by movement of said main operating lever;

an eccentric shaft extending from a master cylinder shaft about which the master cylinder rotates;

a second cam plate transversely spaced from said first cam plate and pivotally coupled to said master cylinder shaft, said second cam plate having a form rollers actuating cam surface and a master cylinder separating cam surface;

a link and arm combination coupled between an outer portion of said second cam plate and said operating shaft so that said second cam plate rotates about said master cylinder shaft when said operating shaft rotates;

a cam follower and form roller link coupling said actuating cam surface to the form rollers; and a cam follower latching means for following said master cylinder separating cam surface and coupled to said master cylinder to selectively move said master cylinder into and out of contact with said rubber blanket cylinder by the camming action between said cam follower latching means and said separating cam surface; whereby the form rollers, master cylinder, and paper feed control mechanism can be controlled by movement of said main operating lever.

2. The improvement as claimed in claim 1, wherein said first cam plate includes a set cam surface for defining a plurality of set positions of said operating lever, and a pump switch cam surface positioned to actuate said pump switch upon actuation of said main operating lever to rotate said first cam surface.

3. The improvement as claimed in claim 2, wherein said pump switch cam surface comprises an outer peripheral edge of said first cam plate.

4. The improvement as claimed in claim 2, wherein said set cam surface comprises recesses along an outer peripheral edge of said first cam plate, said improvement including a spring loaded cam follower having an end resiliently held in one of said recesses, whereby said main operating lever is movable in steps, each step corresponding to a respective recess in said set cam surface.

5. The improvement as claimed in claim 1, wherein said cam follower latching means comprises:

a positioning lever secured to said master cylinder shaft and having a latch engaging portion;

a latch having an end portion engageable with said latch engaging portion; and a cam follower lever having a roller on one end for following said separating cam surface and latch engaging end for moving said latch into and out of engagement with said latch engaging portion of said positioning lever.

6. The improvement as claimed in claim 1 including a latching mechanism coupling said auxiliary operating lever to said paper feed control mechanism, whereby said auxiliary operating lever can be moved to a latch position in which said paper feed control mechanism is latched in a no-feed position.

7. The improvement as claimed in claim 1, wherein said cam follower and form roller link comprise:

a pair of rollers for following said actuating cam surface;

linking arms whose ends are pivotally coupled to said pair of rollers and to the form rollers; and a pair of restraining links, an end of each restraining link being coupled together at a common pivot, and the other end of each restraining link being pivotally coupled to a respective cam following roller.

8. The improvement as claimed in claim 1, wherein said other end of said operating lever link has an elongated slot, said auxiliary operating lever has a pin which extends into said slot, and a spring is provided between said pin and said other end of said operating lever link.

9. The improvement as claimed in claim 1, wherein said paper feed control cam surface comprises the inside peripheral edge of a shaped hole in said first cam plate.

* * * * *